US006450728B1

(12) United States Patent
Grahmbeek et al.

(10) Patent No.: US 6,450,728 B1
(45) Date of Patent: Sep. 17, 2002

(54) PAVING TILE FOR GUIDANCE OF BLIND PERSONS

(76) Inventors: Tamar Vanessa Grahmbeek, Rembrandtweg 75, 1181 GE Amstelveen (NL); Marit Astrid Grahmbeek, Doelen 17, 1935 BN Egmond Binnen (NL)

( * ) Notice: Subject to any disclaimer, the term of this patent is extended or adjusted under 35 U.S.C. 154(b) by 17 days.

(21) Appl. No.: 09/671,085

(22) Filed: Sep. 27, 2000

(30) Foreign Application Priority Data

Sep. 27, 1999 (EP) ..... 992031609

(51) Int. Cl.[7] ..... E01C 15/00

(52) U.S. Cl. ..... 404/15; 404/9; 404/18; 404/19; 404/21; 404/37

(58) Field of Search ..... 404/9, 18, 19, 404/21, 37, 15

(56) References Cited

U.S. PATENT DOCUMENTS

| | | | | | |
|---|---|---|---|---|---|
| 679,237 | A | * | 7/1901 | MacKay | |
| 1,334,565 | A | * | 3/1920 | Spiro | |
| 1,647,861 | A | | 11/1927 | Furey | 404/15 |
| 1,733,471 | A | * | 10/1929 | Smith | |
| 2,574,090 | A | | 11/1951 | Dofsen | 369/21 |
| 3,196,763 | A | * | 7/1965 | Rushton | |
| 5,217,319 | A | * | 6/1993 | Klohn | |
| 5,485,862 | A | * | 1/1996 | Kahn | |
| 5,775,835 | A | * | 7/1998 | Szekely | |
| 5,917,326 | A | * | 6/1999 | Gonzalez et al. | |
| 6,065,266 | A | * | 5/2000 | Behr et al. | |
| 6,070,381 | A | * | 6/2000 | Blumer | |

FOREIGN PATENT DOCUMENTS

| | | | | |
|---|---|---|---|---|
| JP | 401278609 A | | 11/1989 | E01F/9/04 |
| JP | WO 95/03454 | * | 2/1995 | |
| JP | 2000096527 | * | 4/2000 | |

OTHER PUBLICATIONS

Americans with Disabilities ACT—Guidelines on Building Curbs, from www.cs.wright.edu/bhe/rehabengr/ramps/ada-curb.htm; 2 pages.*

* cited by examiner

*Primary Examiner*—Heather Shackelford
*Assistant Examiner*—Katherine Mitchell
(74) *Attorney, Agent, or Firm*—Hayes Soloway P.C.

(57) ABSTRACT

The invention relates mainly to a concrete pavement tile, which produces a clearly recognizable sound when touched with a blind person's cane or a white stick. In practice it appears useful to incorporate sound sources in guide paths for the blind. The invention has solved this problem by providing a pavement tile (1) with an upper plate (3) of metal, which is supported by the tile at its circumference. The plate can be provided with regularly distributed outwardly projecting tears, bumps or ledges (6). Below the plate there is a sound space (2) which can be formed by pressing the plate, upwardly convex, whereas a hollow executed tile gives the same effect.

40 Claims, 2 Drawing Sheets

PAVING TILE FOR GUIDANCE OF BLIND PERSONS

The invention relates mainly to a concrete pavement tile, which produces a clearly recognizable sound when touched with a blind person's cane. In practice in appears useful to incorporate the sound sources in guide paths for the visually impaired for guiding and warning purposes. The invention meets this problem by providing a pavement tile with an upper plate of metal, which is supported by the tile at its circumference. The plate can be provided with projecting tears, bumps, ledges, so that the signal action for the blind will stay. Also, the plate, which stays free from the pavement tile, produces a clearly recognizable sound when touched with the blind person's cane. By taking care that the center of the plate has only a distance of some millimeters above the pavement tile, the plate will bend through elasticity when loaded with a heavy load, but not suffer a permanent bending so that there will no longer be produced a sound. In case of a concrete, wooden, asphalt, artificial, etc. surface one only has to fasten the plate itself to achieve the same result.

Preferably the plate has been fastened water and dust tight on the tile, such as, for instance, by adhesive. Good results are achieved with a more or less flexible adhesive. In case a very heavy load is expected, a support in the middle of the plate could be necessary to anticipate bending the plate permanently. To achieve still a recognizable sound, one can make use of a flexible material support. The hollow can also be formed by pressing the plate hollow, whereas the same effect is reached with a tile having a hollow upper surface.

Figure 1:
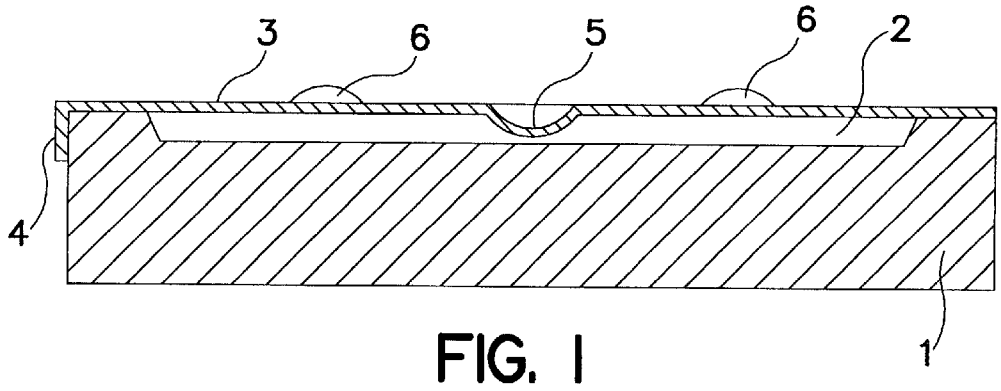
FIG. 1 shows a cross section of a pavement tile having an upper recess.

In FIG. 1 the lower title has been indicated with (1). The lower tile (1) is here provided with a recess (2) forming the sound space. The plate (3) has been adhered on the lower tile (1) and can be provided with an edge (4), which has been bent around the circumference of the tile. In the center of the plate (3) a downwardly projecting bump (5) has been placed, which stays free of the upper surface of the lower tile (1). Furthermore the plate (3) can be provided with regularly spaced, outwardly projecting bumps (6), ledges or tears in order to improve the tactile perception by the feet of the visually impaired and prevent slipping of pedestrians.

Figure 2:
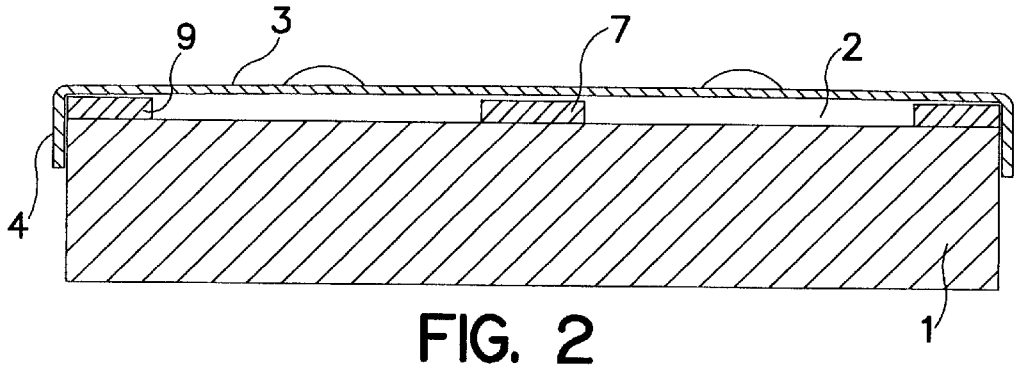
FIG. 2 shows a cross section of a pavement tile in which an edge with an intermediate flange is used.

In FIG. 2 a lower tile (1) with a flat upper surface is shown carrying a plate (3) with a plastic circumference flange (9) which has been adhered to the lower tile (1).

In the center is a support part (7) of the circumference flange (9) which is lower than the flange (9).

Figure 3:
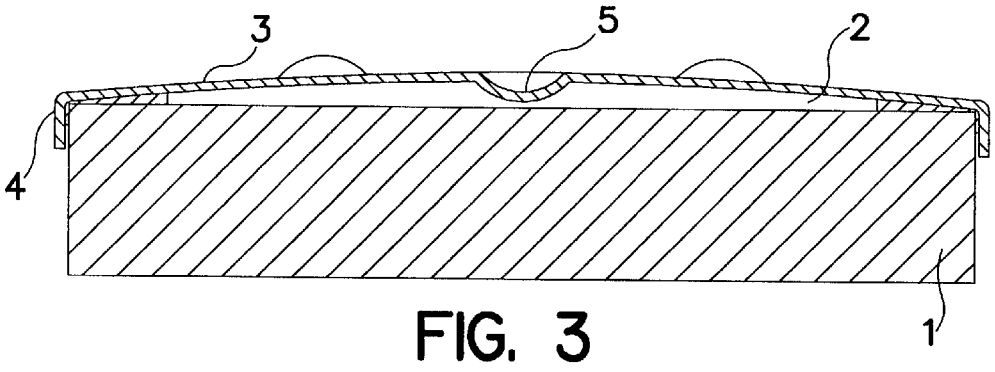
FIG. 3 shows a pavement tile having a plate that has been pressed upwardly convex.

In FIG. 3 a flat lower tile (1) has been shown, having a somewhat convex pressed plate (3), also provided with the inwardly projecting bump (5). The assemblies of lower tile (1) with plate (3) are always as high as the pavement tiles used at the same place. The material of the plate (3) can be: aluminum, possibly anodized in color, steel having a zinc outer layer, or stainless steel. The measure of the bending through of the plates (3) can be varied to obtain a specific sound. Possible bumps can be pressed into the plate FIG. 5

(6) itself or adhered to the plate and can be made from, for instance, synthetic material.

Figure 4:
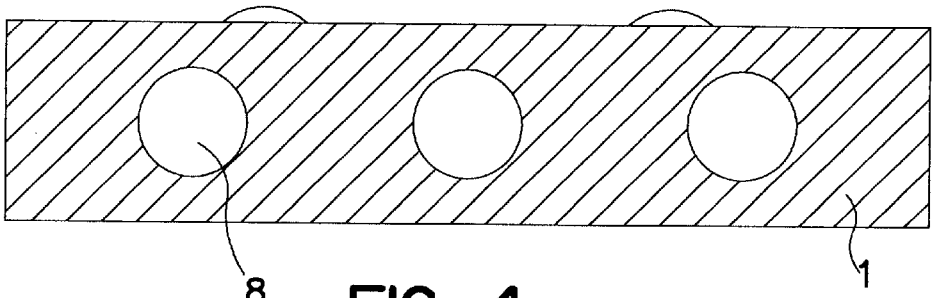
FIG. 4 shows a variant of which the tile has closed recesses.

FIG. 4 shows a variant, in which regularly distributed, closed recesses (8) have been made in the pavement tile, so that when touched this pavement tile gives a different sound than the ones lying around it. The recesses (8) can be both spherical or cylindrical shaped.

Figure 5:
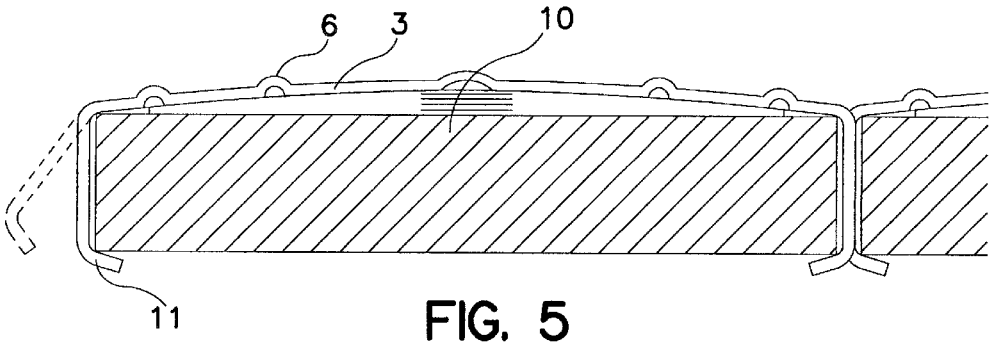
FIGS. 5 and 6 show a plate with connection lips and supporting in the middle.
Figure 6:
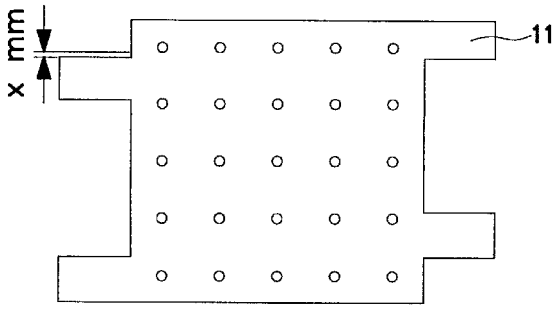

In FIGS. 5 and 6 the plate is connected to the tile by means of lips (11) bent around the tile. The plate is supported in the middle by means of some permanent flexible adhesive material (10). This is useful in case of expected heavy load. The lips are not situated in the length direction because in that case the distances between the tiles can become too large.

Figure 7:
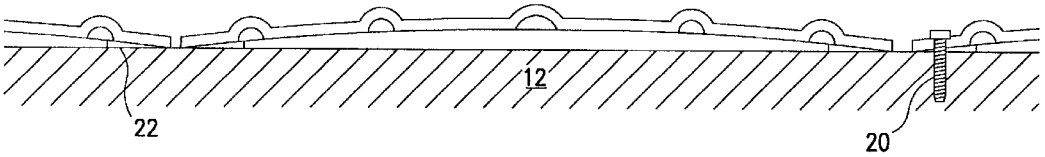
FIG. 7 shows planes directly on a floor surface.

FIG. 7. shows a plate (3) directly situated on the surface like concrete, asphalt, wood, etc., i.e. without an underlying tile. In this case, the plate, typically formed of aluminum, has a generally flat outer edge, and is attached directly to the existing surface, such as a road, walking pavement, railway or airport platform, etc. by means of mechanical fasteners (20) or by means of an adhesive (22).

What is claimed is:

1. Guiding tile for the visually handicapped, comprising a base provided with an upper plate, which, together with the base, forms a sound space which produces sound when touched by a blind person's cane, wherein the plate has a bump directed to the base, which bump stays free from the base in an unloaded condition of the plate.

2. Guiding tile according to claim 1, wherein the plate is fastened to the base by means of an intermediary circumference flange, and the upper side of the flange in the center of the guide tile has a support part.

3. Guiding tile according to claim 1, wherein the plate is upwardly convex bent and is fastened on a flat base.

4. Guiding tile according to claim 1, wherein the plate is provided with an edge which is bent around and grips around a side edge of the base.

5. Guiding tile according to claim 1, wherein the upper surface of the plate is provided with regularly distributed, outwardly projecting bumps, tears or ledges.

6. Guiding tile according to claim 1, wherein the plate is formed of colored anodized aluminum, zinc covered steel or stainless steel.

7. Guiding tile according to claim 1, wherein the base has at an upper side a recess forming the sound space.

8. Guiding tile according to claim 1, wherein the base has a number of regularly distributed closed hollow recesses.

9. Guiding tile according to claim 8, wherein the recesses are spherical or cylindrical.

10. Guiding tile according to claim 1, wherein the plate has integrally formed surface bumps.

11. Guiding tile according to claim 1, wherein the plate has a flexible material support in the middle.

12. Guiding tile according to claim 1, wherein the plate has connection lips formed around the base.

13. Guiding tile for the visually handicapped, comprising a base provided with an upper plate, which, together with the base, forms a sound space which produces sound when touched by a blind person's cane, wherein the plate is fastened to the base by means of an intermediary circumference flange, and the upper side of the flange in the center of the guide tile has a support part, whereby said base in the unloaded condition stays free from the lower side of the plate.

14. Guiding tile according to claim 13, wherein the plate is upwardly convex bent and is fastened on a flat base.

15. Guiding tile according to claim 13, wherein the plate is provided with an edge which is bent around and grips around a side edge of the base.

16. Guiding tile according to claim 13, wherein an upper surface of the plate is provided with regularly distributed, outwardly projecting bumps, tears or ledges.

17. Guiding tile according to claim 13, wherein the plate is formed of colored anodized aluminum, zinc covered steel or stainless steel.

18. Guiding tile according to claim 13, wherein the base has at the upper side a recess forming the sound space.

19. Guiding tile according to claim 13, wherein the base has a number of regularly distributed closed hollow recesses.

20. Guiding tile according to claim 19, wherein the recesses are spherical or cylindrical.

21. Guiding tile according to claim 13, wherein the plate has integrally formed surface bumps.

22. Guiding tile according to claim 13, wherein the plate has a flexible material support in the middle.

23. Guiding tile according to claim 13, wherein the plate has connection lips formed around the base.

24. Guiding tile for the visually handicapped, comprising an upwardly convex bent plate which, when fastened to a base forms a sound space which produces sound when touched by a blind person's cane.

25. Guiding tile according to claim 24, wherein the plate has a bump directed to base, which bump stays free from the base in an unloaded condition of the plate.

26. Guiding tile according to claim 24, wherein the upper surface of the plate is provided with regularly distributed, outwardly projecting bumps, tears or ledges.

27. Guiding tile according to claim 24, wherein the plate is formed of colored anodized aluminum, zinc covered steel or stainless steel.

28. Guiding tile according to claim 24, wherein the plate has integrally formed surface bumps.

29. Guiding tile according to claim 24, wherein the plate has a flexible material support in the middle.

30. Guiding tile according to claim 24, wherein the plate is directly connected with a surface of the floor.

31. Guiding tile according to claim 30, wherein the plate is directly connected to the floor by means of mechanical fasteners.

32. Guiding tile according to claim 30, wherein the plate is directly connected to the floor by means of an adhesive.

33. Guiding tile for the visually handicapped, comprising a base provided with an upper plate, which, together with the base, forms a sound space which produces sound when touched by a blind person's cane, wherein the plate has connection lips formed around the base.

34. Guiding tile according to claim 33, wherein an upper surface of the plate is provided with regularly distributed, outwardly projecting bumps, tears or ledges.

35. Guiding tile according to claim 33, wherein the plate is formed of colored anodized aluminum, zinc covered steel or stainless steel.

36. Guiding tile according to claim 33, wherein the base has at an upper side a recess forming the sound space.

37. Guiding tile according to claim 33, wherein the base has a number of regularly distributed closed hollow recesses.

38. Guiding tile according to claim 37, wherein the recesses are spherical or cylindrical.

39. Guiding tile according to claim 33, wherein the plate has integrally formed surface bumps.

40. Guiding tile according to claim 33, wherein the plate has a flexible material support in the middle.

* * * * *

UNITED STATES PATENT AND TRADEMARK OFFICE

CERTIFICATE OF CORRECTION

PATENT NO. : 6,450,728 B1
DATED : September 17, 2002
INVENTOR(S) : Grahmbeek et al.

It is certified that error appears in the above-identified patent and that said Letters Patent is hereby corrected as shown below:

Title page,
Item [76], Inventors, "Tamar Vanessa Grahmbeek's" address should read
-- Haesackerlaan 47, 1051 ML, Heiloo --.

Signed and Sealed this

Eighteenth Day of May, 2004

JON W. DUDAS
*Acting Director of the United States Patent and Trademark Office*